US006187900B1

(12) United States Patent
Tseng et al.

(10) Patent No.: US 6,187,900 B1
(45) Date of Patent: Feb. 13, 2001

(54) POLYESTER FIBER OF EASY DYEABILITY

(75) Inventors: I-Min Tseng, Nantou; Tung-Ying Kuo, Hsinchu; Wen-Chuan Shu, Hsinchu Hsien; Jih-Chen Huang, Hsinchu, all of (TW)

(73) Assignee: Industrial Technology Research Institute, Hsinchu (TW)

( * ) Notice: Under 35 U.S.C. 154(b), the term of this patent shall be extended for 0 days.

(21) Appl. No.: 09/556,632

(22) Filed: Apr. 21, 2000

(30) Foreign Application Priority Data

Jun. 7, 1999 (TW) ..... 88109410
Dec. 31, 1999 (TW) ..... 88123386

(51) Int. Cl.[7] ..... D02G 3/00

(52) U.S. Cl. ..... 528/364; 528/272; 528/308.6; 525/437; 525/444

(58) Field of Search ..... 528/272, 308.6; 525/437, 444; 428/364

(56) References Cited

U.S. PATENT DOCUMENTS 5,340,909 * 8/1994 Doerr et al. ..... 528/276
5,840,957 * 11/1998 Kurian et al. ..... 560/92
5,849,849 * 12/1998 Bhatia ..... 525/444

* cited by examiner

*Primary Examiner*—Samuel Acquah
(74) *Attorney, Agent, or Firm*—Sughrue, Mion, Zinn, Macpeak & Seas, PLLC

(57) ABSTRACT

The present invention provides a polyester fiber of easy dyeability. The propylene chain of polypropylene terephthalte (PPT) of easy dyeability is incorporated into the main chain of polyethylene terephthalate (PET), and a PPT/PET copolyester having both ethylene and propylene groups can thus be formed. The PPT/PET copolyester is then spun into a copolyester fiber. The copolyester fiber of the present invention can be successfully dyed with a disperse dye at a temperature below 100° C. in the absence of a dye carrier.

12 Claims, No Drawings

POLYESTER FIBER OF EASY DYEABILITY

BACKGROUND OF THE INVENTION

1. Field of the Invention

The present invention relates to a polyester fiber of easy dyeability, and more particularly the invention relates to a polyester fiber containing polypropylene terephthalate/polyethylene terephthalate (PPT/PET) copolyester.

2. Description of the Prior Art

Polyethylene terephthalate (PET) has high strength and good stain resistance, which has been widely and extensively used in the textile field. However, PET has poor dyeability and unmodified PETs can only be dyed with a disperse dye at an elevated temperature of more than 130° C. Such a high temperature requires equipment that can withstand high pressure, which inevitably will cause an increase in the production cost. It is known that the dyeability of PET fibers or fabrics can be improved by using a dye carrier. However, it is also known that the dye carrier will remain in the dyeing waste water, fiber, and fabrics after being processed, which can cause profoundly adverse influence to the environment. Furthermore, the above-mentioned high pressure dyeing process also contributes to the increase of the production cost.

Polypropylene terephthalate (PPT) has the advantages of having the high elastic resilience of nylon and chemical resistance of PET. Also, PPT has better dimensional stability and dyeability than PET and PBT (polybutylene terephthalate) . In the absence of a dye carrier, PPT can still be dyed in rich colors continuously with a disperse dye in boiling water under normal pressure. Having the above properties, PPT has gradually replaced nylon as the material of choice for fabricating such textile materials as the carpet.

In order to improve the dyeability of PET, researchers have tried to blend PPT of good dyeability with PET. For example, a Japanese Patent Publication (Kokai) No. 11-93022 discloses a polyester composite fiber that includes a core made of PET and a sheath made of PPT. The core also contains an antistatic agent. Such a core/sheath composite fiber can be dyed with a disperse dye at a temperature lower than 110° C. while maintaining good heat setting and high antistatic properties. In order to produce such fiber, the sheath portion and the core portion need to be prepared first and followed by a melt spinning process.

In addition, another Japanese Patent Publication (Kokai) No. 59-211620 discloses a process for preparing a polyester flat yarn used for producing high twist textile. In this process, PET, PPT, and/or PBT are blended and melt-spun, which are then subjected to roller extension for preparing the polyester flat yarn.

There have also been many efforts made to produce the PPT/PET copolyester, wherein the main process employed comprises an esterification reaction and a polycondensation reaction. Nevertheless, a polyester fiber containing PPT/PET copolyester has not been produced yet.

Furthermore, dimethyl terephthalate (DMT) is conventionally used as the monomer in the esterification reaction for producing the PPT/PET copolyester. The problem here, however, is that methanol by-product is typically difficult to be recovered and that DMT has always been a very expensive compound. Methods for producing the PPT/PET copolyester can be seen in JP53094393A (1978) of Japan; Ponnusamy and Balakrishnan, J. Macromol. Sci.-Chem., A22(3), pp.373–378 (1985) of India; and U.S. Pat. No. 5,340,909 (1994). Ponnusamy and Balakrishnan synthesize a PPT/PET copolyester by reacting dimethyl terephthalate (DMT), ethylene glycol, and 1,3-propanediol in a melt-polycondensation reaction. However, the obtained PPT/PET copolyester has too small a molecular weight, and the maximum intrinsic viscosity ([η]) is only 0.4 dL/g (solvent: o-chlorophenol, 30±0.1° C.) with no practical value.

DuPont Company in U.S. Pat. No. 5,840,957 (1998) and U.S. Pat. No. 5,849,849 (1998), on the other hand, produces bis(3-hydroxypropyl) terephthalate (BHPT) via a transesterification reaction using lanthanum beta-diketone as the catalyst. Then, BHPT can be polymerized in an inert gas under atmospheric pressure to form PPT, wherein large scale production equipment capable of processing a large amount of flowing nitrogen gas are required thus increasing the equipment cost. Further, the reaction system used in this process is different from the conventional reaction system for producing polyester. Therefore, the conventional system for producing polyester can not be directly adapted for producing PPT by this process.

Chisso Company, disclosed in JP 06002282A (1994), uses a 2,2-alkyl substituted 1,3-PDO, such as 2-butyl-2-ethyl-1,3-PDO, to modify PET. The dyeability can then be improved by using a disperse dye. However, such a 2,2-alkyl substituted 1,3-PDO monomer is not easily accessible in the market; therefore, this technique is difficult to be applied in the conventional polyester field.

Yang Ho Park et al. produce PPT/PET copolyester by reacting PET oligomer and 1,3-propanediol (1,3-PDO, also abbreviated as PG) in a polycondensation reaction (*Journal of the Korean Fiber Society*, Vol. 36, No. 7, 1999). Theoretically, the alcohol content of the PET oligomer should be reacted with 1,3-propanediol by an interchange reaction and then by a polycondensation reaction to produce a PPT/PET copolyester. The ethylene glycol by-product formed during the interchange reaction must be removed, which adversely increases the cost of production.

From the above conventional techniques, it is known that a fiber containing a mixture of PPT and PET has been developed, however, no dyeable polyester fiber containing a PPT/PET copolyester has been developed yet.

SUMMARY OF THE INVENTION

The object of the present invention is to solve the problem of the conventional PET fiber and textile in which said PET material can not be easily dyed and to provide an improved polyester fiber of easy dyeability. The present invention incorporates an appropriate amount of the PPT polyester chain of good dyeability into the PET polyester main chain to synthesis a polypropylene terephthalate/polyethylene terephthalate (PPT/PET) copolyester. The fiber and textile made from the PPT/PET copolyester of the present invention can be successfully dyed with a disperse dye at a temperature below 100° C. in the absence of a dye carrier. Since the dyeing temperature is lower than the boiling point temperature of the monomers, the dyeing process can be performed under normal pressure, which makes the process safer. The energy cost can be reduced, and at the same time the waste water amount can be greatly decreased. In addition, the dyeability of the PPT/PET copolyester fiber according to the present invention is better than that of the conventional PET fiber, and it can even be better than that of the PPT fiber.

To achieve the above objects, the present invention provides an improved polyester fiber of easy dyeability. This polyester fiber includes polypropylene terephthalate/polyethylene terephthalate (PPT/PET) copolyester, wherein the copolyester includes the following repeating unit (I) and repeating unit (II), (I)

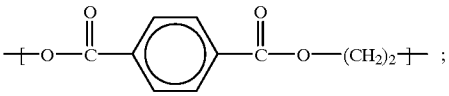

(II)

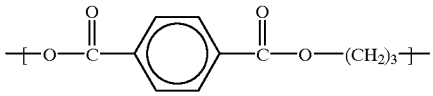

and wherein the backbone structure of the copolyester includes ethylene and propylene with the molar ratio of the ethylene to propylene ranging from 99/1 to 1/99.

DETAILED DESCRIPTION OF THE INVENTION

In the following preferred examples, the molar ratio of the ethylene to propylene group in the backbone structure of the PPT/PET copolyester is preferably in the range of 60/40 to 99/1, and more preferably 70/30 to 95/5.

The PPT/PTE copolyester used to prepare the polyester fiber of the present invention preferably has an intrinsic viscosity [η] of 0.5–1.5 dL/g determined at 25±0.2° C. using phenol/tetrachloroethane (3/2, w/w) as the solvent.

According to a first preferred embodiment of the present invention, the PPT/PET copolyester can be prepared by the following steps. First, bis(3-hydroxypropyl)terephthalate (BHPT), terephthalic acid, and ethylene glycol are reacted together in an esterification reaction. Then, the esterified product is subjected to undergo a polycondensation reaction. In the above process, ethylene glycol and terephthalic acid can be fed in a molar ratio of 1.0 to 4.0 and preferably 1.1 to 1.5. Further, terephthalic acid and BHPT can be fed in a molar ratio of from 99/1 to 1/99, whereas the molar ratio is preferably of from 60/40 to 99/1 and more preferably from 70/30 to 95/5.

The bis(3-hydroxypropyl)terephthalate suitable for use in the present invention can be either a monomer or an oligomer obtained from reacting terephthalic acid and 1,3-propanediol via an esterification reaction. 1,3-propanediol and terepthalic acid can be fed in a molar ratio of from 1.0 to 4.0, and preferably from 1.1 to 1.5. Alternatively, bis(3-hydroxypropyl)terephthalate used can be either a monomer or an oligomer obtained from reacting dimethyl terephthalate (DMT) and 1,3-propanediol via an ester exchange reaction.

According to a second preferred embodiment of the present invention, the PPT/PET copolyester can be prepared via the following steps. First, terephthalic acid, ethylene glycol, and 1,3-propanediol are reacted together in an esterification reaction. Then, the esterified product is subjected to undergo a polycondensation reaction. In the above process, ethylene glycol and 1,3-propanediol can be fed in a molar ratio of from 99/1 to 1/99, whereas the molar ratio is preferably of from 60/40 to 99/1 and more preferably from 70/30 to 95/5.

The esterification reaction in the present invention can be conducted at a room temperature up to a temperature of 280° C., preferably 200° C. to 260° C., and the esterification ratio is preferably controlled to 90% to 99%. The polycondesation can be conducted at a temperature of 200° C. to 280° C. According to the present invention, by controlling the corresponding usage amounts of BHPT, terephthalic acid, and ethylene glycol, the PPT/PET copolyester fiber containing a desired ethylene/propylene molar ratio can be obtained.

The main difference between PPT and PET resides in their structural units. In PPT, the soft chain is of the more flexible $(CH_2)_3$ group with an odd carbon number. In PET, the soft chain is of the more rigid $(CH_2)_2$ group with an even carbon number. With such structural differences, PPT has indeed a superior dyeability than PET. The present invention incorporates an appropriate amount of $(CH_2)_3$ chain of PPT into the main chain of PET, so the PPT/PET copolyester having both $(CH_2)_2$ and $(CH_2)_3$ groups can be formed accordingly. Further, the PPT/PET copolyester fiber can also be produced by using the conventional fiber process. The fiber of the PPT/PET copolyester with both $(CH_2)_2$ and $(CH_2)_3$ groups has a dyeability superior than that of the PET, and it can even be better than that of the PPT. In addition, the PPT/PET copolyester of the present invention can be prepared by directly adapting conventional polyester apparatuses.

The following examples are intended to illustrate the process and the advantages of the present invention more fully without limiting its scope, since numerous modifications and variations will be apparent to those skilled in the art.

EXAMPLE 1

Synthesis of bis(3-hydroxypropyl)terephthalate (BHPT)

50.6 kg of terephthalic acid (TPA) and 30.2 kg of 1,3-propanediol (PDO) were charged in an esterification vessel and stirred thoroughly at a stirring rate of 130 rpm in the presence of an esterification catalyst. Nitrogen was then introduced at a flow rate of 4 L/min, and the reaction pressure was maintained at 2 kg/cm$^2$G. The internal temperature of the esterification vessel was increased to 245° C. During the esterification process, the byproducts water and 1,3-PDO were separated by using a separation tower such that 1,3-PDO was introduced to the esterification reaction system and that water was made to flow out from the top of the tower, which is then cooled and recovered. The total esterification reaction time was 3.5 hours. The esterified product BHPT was cooled and crushed, by which the saponification value can be determined, and the saponification value was then converted to have a calculated esterification conversion of 98.1%. The reaction conditions are summarized in Table 1.

EXAMPLE 2

Synthesis of PPT/PET Copolyester from BHPT 55 kg of TPA, 27 kg of ethylene glycol (EG), and 4.5 kg of BHPT (obtained from Example 1) were charged in an esterification vessel and stirred thoroughly at a stirring rate of 130 rpm in the presence of the $Sb_2O_3$ catalyst. The molar ratio of EG and TPA was 1.3, whereas the molar ratio of TPA and BHPT was 95:5. In addition, nitrogen was introduced at a flow rate of 4 L/min, and the reaction pressure was maintained at 2 kg/cm$^2$G. The internal temperature of the esterification vessel was increased to 255° C. During the esterification process, the byproducts water and 1,3-PDO were separated by using a separation tower such that 1,3-PDO was introduced to the esterification reaction system and that water was made to flow out from the top of the tower, which is then cooled and recovered. The total esterification reaction time was 3.3 hours. The esterified product was then moved into a polymerization vessel to proceed the polymerization reaction. The vacuum was equal to or less than 1 torr. Furthermore, the polymerization temperature was controlled to 255° C.–270° C., and the stirring rate was first 60 rpm and then decreased to 30 rpm during the reaction. The total polymerization time was 3.5 hours.

Finally, the PPT/PET copolyester product in molten form was extruded into filaments, cooled in a cool water vessel, and then cut into PPT/PET copolyester chips having an intrinsic viscosity (IV) of 0.62 dL/g. The reaction conditions are summarized in Table 1. The composition, intrinsic viscosity, and thermal properties of the PPT/PET copolyester are shown in Table 2.

EXAMPLE 3

Synthesis of PPT/PET Copolyester from BHPT 50 kg of TPA, 24.3 kg of EG, and 19.1 kg of BHPT (obtained from Example 1) were charged in an esterification vessel and stirred thoroughly at a stirring rate of 130 rpm in the presence of the $Sb_2O_3$ catalyst. The molar ratio of EG and TPA was 1.3, whereas the molar ratio of TPA and BHPT was 82:18. Nitrogen was introduced at a flow rate of 4 L/min, and the reaction pressure was maintained at 2 kg/cm$^2$G. The internal temperature of the esterification vessel was increased to 245° C. During the esterification process, the byproducts water and 1,3-PDO were separated by using a separation tower such that 1,3-PDO was introduced to the esterification reaction system and that water was made to flow out from the top of the tower, which was then cooled and recovered. The total esterification reaction time was 3.5 hours. The esterified product was then moved into a polymerization vessel to proceed the polymerization reaction. The vacuum was equal to or less than 1 torr. Furthermore, the polymerization temperature was controlled to 245° C.–255° C., and the stirring rate was first 60 rpm and then decreased to 30 rpm during the reaction. The total polymerization time was 4 hours. Finally, the PPT/PET copolyester product in molten form was extruded into filaments, cooled in a cool water vessel, and then cut into PPT/PET copolyester chips having an intrinsic viscosity (IV) of 0.66 dL/g. The reaction conditions are summarized in Table 1. The composition, intrinsic viscosity, and thermal properties of the PPT/PET copolyester are shown in Table 2.

EXAMPLE 4

Synthesis of PPT/PET Copolyester from TPA, EG, and 1,3-PDO 30 kg of TPA, 7.3 kg of EG, and 8.9 kg of 1,3-PDO were charged in an esterification vessel and stirred thoroughly at a stirring rate of 130 rpm in the presence of the $Sb_2O_3$ catalyst. The molar ratio of EG and 1,3-PDO was 50:50. Nitrogen was introduced at a flow rate of 4 L/min, and the reaction pressure was maintained at 2 kg/cm$^2$G. The internal temperature of the esterification vessel was gradually increased to 240° C. During the esterification process, the byproducts water, EG and 1,3-PDO were separated by using a separation tower such that EG and 1,3-PDO were introduced to the esterification reaction system and that water was made to flow out from the top of the tower, which was then cooled and recovered. The total esterification reaction time was 3 hours. The esterified product was then moved into a polymerization vessel to proceed the polymerization reaction. The vacuum was equal to or less than 1 torr, and the polymerization temperature was controlled to 245° C.–255° C. The total polymerization time was 2.5 hours. Finally, the PPT/PET copolyester product in molten form was extruded into filaments, cooled in a cool water vessel, and then cut into PPT/PET copolyester chips having an intrinsic viscosity (IV) of 0.55 dL/g. The reaction conditions are summarized in Table 1. The composition, intrinsic viscosity, and thermal properties of the PPT/PET copolyester are shown in Table 2. The PPT/PET copolyester was determined for DMA and the obtained Tg curve has only one peak, indicating that the PPT/PET copolyester is a homogeneous phase, not a mixture of PPT and PET.

EXAMPLE 5

Synthesis of PPT from 1,3-PDO and TPA 50.6 kg of TPA and 30.2 kg of 1,3-PDO were charged in an esterification vessel and stirred thoroughly at a stirring rate of 130 rpm in the presence of the $Sb_2O_3$ catalyst. Nitrogen was introduced at a flow rate of 4 L/min, and the reaction pressure was maintained at 2 kg/cm$^2$G. The internal temperature of the esterification vessel was gradually increased to 245° C. During the esterification process, the byproducts water and 1,3-PDO were separated by using a separation tower such that 1,3-PDO were introduced to the esterification reaction system and that water was made to flow out from the top of the tower, which was then cooled and recovered. The total esterification reaction time was 3.5 hours. The esterified product was then moved into a polymerization vessel to proceed the polymerization reaction. The vacuum was equal to or less than 1 torr, the polymerization temperature was controlled to about 255° C. and the stirring rate was first 60 rpm and then decreased to 30 rpm during the reaction. The total polymerization time was 4 hours. Finally, the PPT product in molten form was extruded into filaments, cooled in a cool water vessel, and then cut into PPT chips having an intrinsic viscosity (IV) of 0.8 dL/g. The reaction conditions are summarized in Table 1.

EXAMPLE 6

The Preparation of PPT/PET Copolyester Fiber

The PPT/PET copolyester chips obtained from Example 2 and Example 3, and the PPT chips obtained from Example 5 were melt spun in a spinning machine at a spinning temperature of 200° C. to 260° C. and at a spinning rate of 3000 m/min into partially oriented yarns (POY) having a fineness of 1.3 dpf (deniers per filament), a strength of 2.3 g/d, and an elongation of higher than 100%. The POY of polyester was then spun by a textured machine into draw-textured yarns (DTY) of 0.9 dpf. The strength of the PPT/PET copolyester DTY prepared from the chips of Example 2 was higher than 2.9 g/d, and the strength of the PPT/PET copolyester DTY prepared from the chips of Example 3 was higher than 3.4 g/d. Further, the PET fiber from Hualon Corporation (tradename: P-DTY 75D/72f) and the above three kinds of PPT/PET copolyester DTY fibers were made into circular knits and then dyed. The dyed samples were measured for color strength (the total K/S reflectivity), washing fastness, and light fastness to compare their dyeability. The results are shown in Table 3.

The washing fastness and light fastness were expressed by ratings. Rating 4 indicates excellent while rating 2 indicates fair. The color strength was expressed by the total K/S reflectivity. Larger K/S value indicates that the sample was dyed deeper. It can be seen from Table 3 that the PET textile and the PPT/PET copolyester textile have a better dyeability than the PET textile. The PPT/PET copolyester textile with an ethylene to propylene molar ratio of 74:26 (from Example 3) has a even better dyeability than the PPT textile.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

TABLE 1

The basic reaction conditions for Examples 1–4

| | | Feedstock | | | | | Esterification reaction | | | Esterification | Polymerization reaction | | |
|---|---|---|---|---|---|---|---|---|---|---|---|---|---|
| Example | Product | 1,3-PDO (kg) | EG (kg) | TPA (kg) | BHPT (kg) | Catalyst | Temp (° C.) | Pressure (kg/cm$^2$G) | Time (hr) | Conversion (%) | Temp (° C.) | Vacuum (torr) | Time (hr) |
| 1 | BHPT | 30.2 | — | 50.6 | — | Ti- | ~245 | 2 | 3.5 | 98.1 | — | — | — |
| 2 | PPT/PET | — | 27 | 55 | 4.5 | Sb- | ~255 | 2 | 3.3 | — | ~270 | <1 | 3.5 |
| 3 | PPT/PET | — | 24.3 | 50 | 19.1 | Sb- | ~245 | 2 | 3.5 | — | ~255 | <1 | 4 |
| 4 | PPT/PET | 8.9 | 7.3 | 30 | — | Ti-, Sb- | ~240 | 2 | 3 | — | ~255 | <1 | 2.5 |
| 5 | PPT | 30.2 | — | 50.6 | — | Ti-, Sb- | ~245 | 2 | 3.5 | — | ~255 | <1 | 4 |

TABLE 2

The composition, intrinsic viscosity, and thermal properties of the polyester

| | Copoly- | Composition determined by NMR (mol %) | | [η][1] | Tg[2] | Tm[2] |
|---|---|---|---|---|---|---|
| Example | mer | —$(CH_2)_2$— | —$(CH_2)_3$— | dL/g | ° C. | ° C. |
| 2 | PPT/PET | 93 | 7 | 0.62 | 72 | 238 |
| 3 | PPT/PET | 74 | 26 | 0.66 | 65 | —[3] |
| 4 | PPT/PET | 44 | 56 | 0.55 | 48 | 170 |

Note:
[1]The intrinsic viscosity is determined at 25 ± 0.2° C. by using phenol/teterachloroethane = 3/2 w/w as the solvent.
[2]Tg and Tm are determined by DSC.
[3]The DSC determination indicates that this copolyester has no Tm.

TABLE 3

The dyeability of the circular knits of the polyester DTY[1]

| | | Composition determined by NMR (mol %) | | Washing fastness[2] | | Light | K/S |
|---|---|---|---|---|---|---|---|
| Example | Polymer | —$(CH_2)_2$— | —$(CH_2)_3$— | PES | PA | fastness[3] | value[4] |
| —[5] | PET | 100 | 0 | 3 | 2–3 | 4 | 47 |
| 2 | PPT/PET | 93 | 7 | 3 | 2–3 | 4 | 163 |
| 3 | PPT/PET | 74 | 26 | 4 | 3 | 4 | 368 |
| 5 | PPT | 0 | 100 | 4 | 2–3 | 4 | 322 |

Note:
[1]The circular knits are dyed with Dianix Blue KRN-FS 2.1% at 100° C. for 45 minutes and then washed with NaOH 2 g/L at 80° C. for 20 minutes.
[2]Washing fastness is measured according to the AATCC 61-1996 2A method. PES indicates polyester fiber, and PA indicates nylon fiber.
[3]Light fastness is measured according to the AATCC 16 method and the exposure is performed by arc for 20 hours.
[4]The total K/S reflectivity is determined in the Datacolor E2000 with D65 light source.
[5]The sample is the PET fiber from Hualon Corporation under the tradename of P-DTY 75D/72f.

What is claimed is:

1. A polyester fiber of easy dyeability, comprising polypropylene terephthalate/polyethylene terephthalate (PPT/PET) copolyester, wherein the copolyester includes the following repeating unit (I) and repeating unit (II), (I)

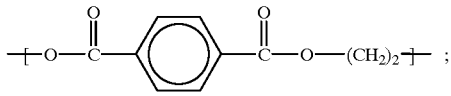

(II)

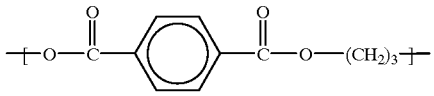

wherein the backbone structure of the copolyester includes ethylene and propylene, and wherein the molar ratio of the ethylene to propylene ranges from 99/1 to 1/99.

2. The polyester fiber as claimed in claim 1, wherein the molar ratio of the ethylene to propylene ranges from 60/40 to 99/1.

3. The polyester fiber as claimed in claim 2, wherein the molar ratio of the ethylene to propylene ranges from 70/30 to 95/5.

4. The polyester fiber as claimed in claim 1, wherein the polypropylene terephthalate/polyethylene terephthalate copolyester has intrinsic viscosity [η] of 0.5–1.5 dL/g.

5. The polyester fiber as claimed in claim 1, wherein the polypropylene terephthalate/polyethylene terephthalate copolyester is prepared from the following steps:

(a) reacting bis(3-hydroxypropyl)terephthalate (BHPT), terephthalic acid, and ethylene glycol to proceed an esterification reaction; and (b) subjecting the esterified product from step (a) to a polycondensation reaction, wherein the terephthalic acid and BHPT are fed with a molar ratio of from 99/1 to 1/99.

6. The polyester fiber as claimed in claim 5, wherein the terephthalic acid and BHPT are fed with a molar ratio of from 60/40 to 99/1.

7. The polyester fiber as claimed in claim 6, wherein the terephthalic acid and BHPT are fed with a molar ratio of from 70/30 to 95/5.

8. The polyester fiber as claimed in claim 5, wherein the bis(3-hydroxypropyl)terephthalate is a monomer or oligomer obtained by reacting terephthalic acid and 1,3-propanediol via an esterification reaction.

9. The polyester fiber as claimed in claim 5, wherein the bis(3-hydroxypropyl)terephthalate is a monomer or oligomer obtained by reacting dimethyl terephthalate and 1,3-propanediol via an ester exchange reaction.

10. The polyester fiber as claimed in claim 1, wherein the polypropylene terephthalate/polyethylene terephthalate copolyester is prepared from the following steps:

(a) reacting terephthalic acid, ethylene glycol, and 1,3-propanediol to proceed an esterification reaction; and (b) subjecting the esterified product from step (a) to undergo a polycondensation reaction, wherein the ethylene glycol and 1,3-propanediol are fed with a molar ratio of from 99/1 to 1/99.

11. The polyester fiber as claimed in claim 1, wherein the ethylene glycol and 1,3-propanediol are fed with a molar ratio of from 60/40 to 99/1.

12. The polyester fiber as claimed in claim 11, wherein the ethylene glycol and 1,3-propanediol are fed with a molar ratio of from 70/30 to 95/5.

* * * * *